US006240658B1

(12) United States Patent
Knutson et al.

(10) Patent No.: US 6,240,658 B1
(45) Date of Patent: Jun. 5, 2001

(54) LIGHTWEIGHT SNOWPLOW ASSEMBLY

(76) Inventors: Gregory A. Knutson, 10708 Glen Eagle Rd., Woodbury, MN (US) 55129; William W. Wilkerson, 2465 Ryan Ave., North St. Paul, MN (US) 55109

( * ) Notice: Subject to any disclaimer, the term of this patent is extended or adjusted under 35 U.S.C. 154(b) by 0 days.

(21) Appl. No.: 09/196,980

(22) Filed: Nov. 20, 1998

Related U.S. Application Data

(60) Provisional application No. 60/065,968, filed on Nov. 20, 1997.

(51) Int. Cl.[7] ..... E01H 5/04

(52) U.S. Cl. ..... 37/231; 37/272

(58) Field of Search ..... 37/231, 232, 266, 37/272, 275, 241; 172/253, 810, 811, 817

(56) References Cited

U.S. PATENT DOCUMENTS

| | | | | |
|---|---|---|---|---|
| 1,891,046 | * | 12/1932 | Gettelman | 17/272 |
| 2,152,092 | * | 3/1939 | Rougier | 37/232 |
| 2,290,060 | * | 7/1942 | Massey | 37/232 |
| 2,642,294 | * | 6/1953 | Holm | 280/33.13 |
| 3,349,507 | * | 10/1967 | Payne | 37/272 |
| 3,483,642 | * | 12/1969 | Glesmann | 37/232 |
| 3,845,577 | * | 11/1974 | Naymik | 172/817 |
| 3,987,562 | | 10/1976 | Deen et al. . | |
| 4,024,653 | | 5/1977 | Morris . | |
| 4,384,620 | * | 5/1983 | Uchida et al. | 37/275 |
| 4,597,202 | * | 7/1986 | Weeks | 37/272 |
| 4,680,880 | | 7/1987 | Boneta . | |
| 4,845,866 | | 7/1989 | Ciula . | |
| 4,976,053 | * | 12/1990 | Caley | 37/231 |
| 5,136,795 | * | 8/1992 | Rosenberg | 37/231 |
| 5,207,010 | | 5/1993 | Grossman . | |
| 5,509,219 | | 4/1996 | Mecca . | |
| 5,666,747 | * | 9/1997 | MacQueen | 37/231 |
| 5,860,230 | * | 1/1999 | Daniels | 37/232 |
| 5,909,960 | * | 6/1999 | Jager et al. | 37/231 |
| 5,924,223 | * | 7/1999 | Hone, Jr. | 37/266 |
| 6,012,240 | * | 1/2000 | Klug et al. | 172/817 |

OTHER PUBLICATIONS

Product Brochure: Soltec Corporation. The Affordable Car Snow Plow Assembly; USA; 2 Pages (1997).

* cited by examiner

*Primary Examiner*—Thomas B. Will
*Assistant Examiner*—Kristine M. Markovich

(57) ABSTRACT

A lightweight snowplow assembly for mounting to the front of a vehicle. The snowplow assembly is comprised of a V-shaped plow blade portion and a support structure. The plow blade portion includes a nose blade and adjacent side blades. Wear strip members are attached to the bottom of the blade portion and chute members are mounted to the top of each side blade. A mounting structure is attached to the support frame of the plow portion and is constructed and arranged to attach the snowplow assembly to the front of the vehicle. The mounting structure includes a mounting frame, a pair of bumper pads and top and bottom adjustable strap members. The strap members are attached to predetermined positions above and below the bumper of the vehicle.

17 Claims, 6 Drawing Sheets

LIGHTWEIGHT SNOWPLOW ASSEMBLY

BACKGROUND OF THE INVENTION

This application claims the benefit of U.S. Provisional Application No. 60/065,968, filed Nov. 20, 1997.

This inventions relates to snowplow assemblies and particularly to lightweight snowplow assemblies constructed and arranged for attachment to the front of a vehicle, such as an automobile or like small vehicle.

Although prior art snowplow assemblies have been proposed and manufactured for use with vehicles, these assemblies have typically had various shortcomings that limit the use and function of the snowplow. Although snowplow assemblies have included those used for automobiles, for example, most prior art assemblies are either complex and heavy for small vehicle use or are constructed in such a manner that they are difficult and inefficient to use. Other prior art devices have been found difficult to assemble, difficult to install on a vehicle and difficult to remove after use.

The lightweight snowplow assembly of the present invention overcomes the shortcomings and difficulties of the prior art snowplow assemblies. The snowplow assembly of the present invention is lightweight and economical in construction. The assembly is constructed and arranged so that it is easily assembled, adjusted and installed on the front of a vehicle. The snowplow assembly is adapted for a wide range of use on the front of a variety of vehicle designs. The lightweight nature of the snowplow -assembly of this invention provides an efficient and economical plow assembly for automobiles, mini-vans, light trucks, medium size sport utility vehicles and the like. Although the lightweight snowplow assemblies are well suited for smaller vehicles, it is within the purview of the invention to enable the utilization of the snowplow assemblies with larger vehicles, for example, 4×4 trucks. In the latter case, the assemblies would be in larger scale for adaptation to the larger front dimensions (width and height) of the vehicle.

The snowplow assembly of the invention has a flexible V-shaped blade structure suited for use with smaller vehicles. The snowplow assembly further is constructed and arranged to be free floating to, thereby, be usable for plowing on various surfaces.

SUMMARY OF THE INVENTION

The lightweight snowplow assembly of this invention is mounted to a vehicle and used for snow removal. The snowplow assembly is easily assembled and can be readily mounted onto and removed from the front of an automobile or similar small vehicle. The assembly is constructed and arranged for easy adjustable attachment to the front of the vehicle, and the assembly is adapted to be adjusted to fit a variety of automobile and small vehicle sizes and configurations.

The lightweight snowplow assembly is comprised of a V-shaped snowplow blade portion and a cooperating harness or mounting structure. The snowplow portion is comprised of a plurality of blade members to form the V-shaped blade portion and is mounted to a support frame structure for attachment to the harness or mounting frame structure. The blade elements of the snowplow portion have wear pads mounted on the bottom thereof and the blade elements of the snowplow are positioned to form an obtuse angle to push and remove snow. Further chute structures are mounted on the top of the side blade members of the snowplow blade portion to guide snow away from the plow for snow removal purposes.

The harness or mounting structure of the snowplow assembly is comprised of a mounting frame and means to attach the harness portion to the snowplow portion. The mounting structure of the snowplow assembly is constructed and arranged to connect the assembly to the front of a vehicle. The harness or mounting portion has bumper pad elements to mount the snowplow assembly with respect to the bumper of the vehicle. The pads are provided to protect the car bumper from damage and to direct forces to the plow assembly from the vehicle bumper during plowing.

The harness portion further has adjustable strap members which are adapted to be easily adjusted during assembly and to provide for the attachment of the snowplow assembly to different sizes and front end configurations of a range of vehicles. The strap members include a pair of upper and lower straps that attach to predetermined positions above and below the bumper of the vehicle. A biasing structure operative between the snowplow portion and the harness assembly is also provided to maintain the snowplow in a downward position during operation.

These and other benefits of this invention will become clear from the following description by reference to the drawings.

DESCRIPTION OF THE PREFERRED EMBODIMENTS

Figure 1:
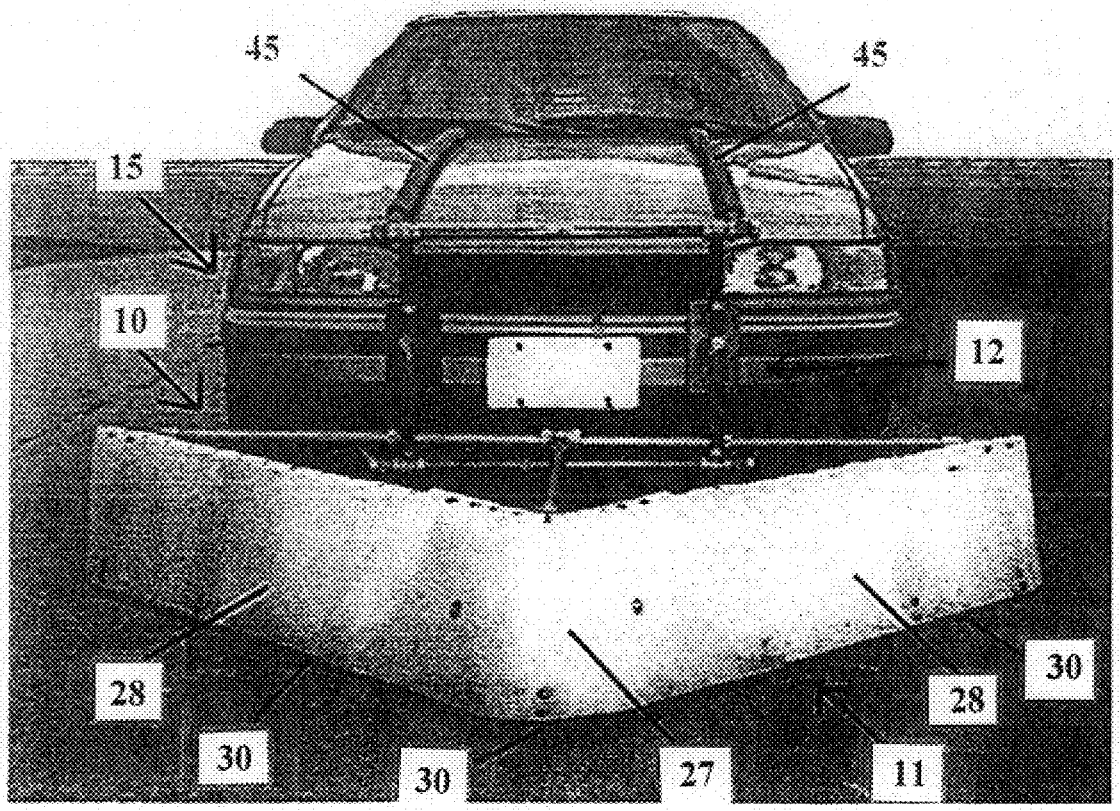
FIG. 1 is a perspective view of the lightweight snowplow assembly of the present invention and shown mounted to the front of a vehicle.

FIG. 1 shows the snowplow assembly 10 of this invention comprised of a snowplow portion 11 and a harness or mounting structure 12. The snowplow assembly 10 is shown mounted for use on the front of vehicle 15. The vehicle to which the snowplow assembly 10 may be mounted include automobiles, mini-vans, light trucks, sports utility vehicles, and other small vehicles. The snowplow assembly 10 is constructed and arranged to be easily and quickly adjusted, mounted and removed from the front of such vehicles.

Figure 2:
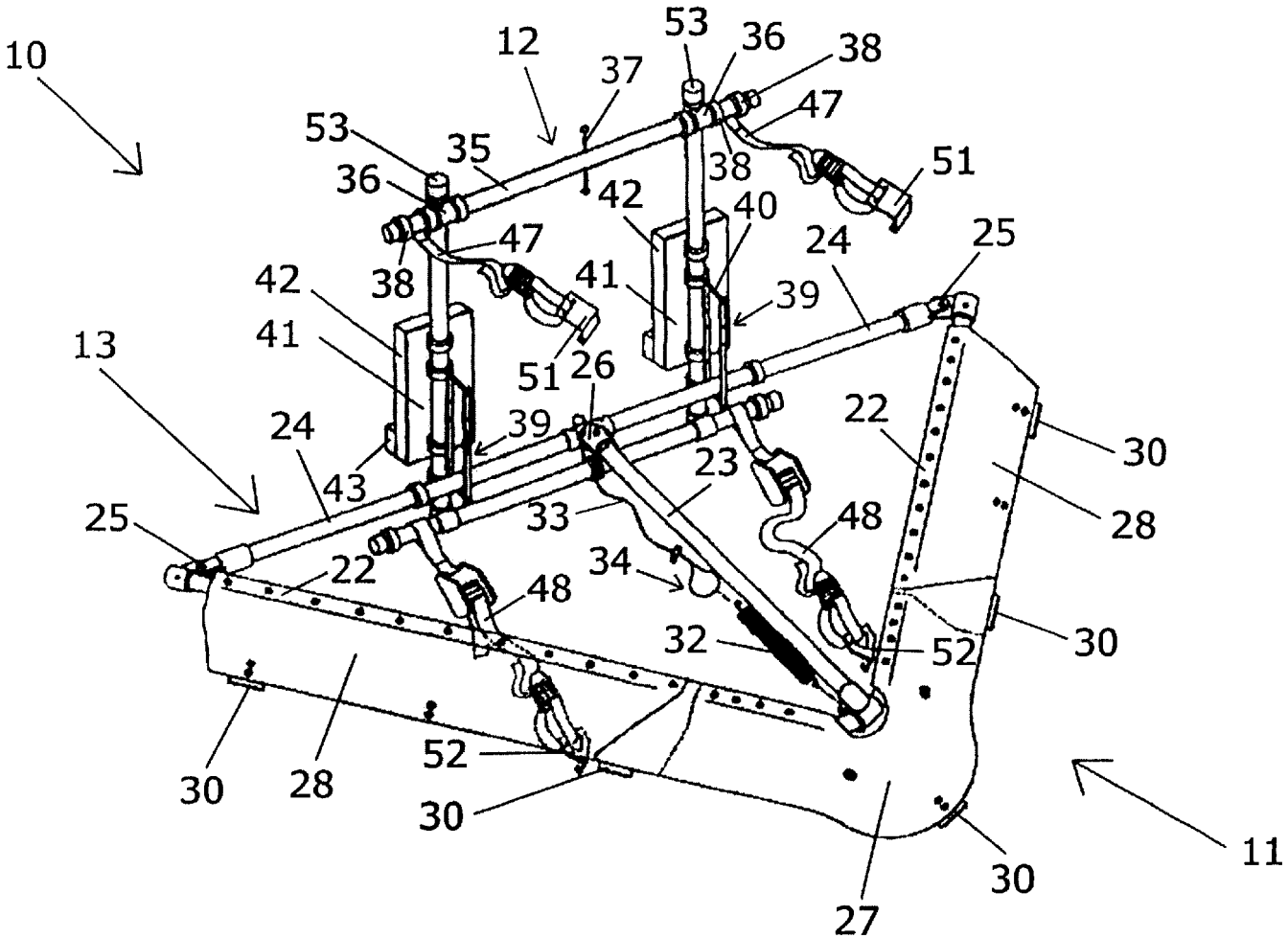
FIG. 2 is a perspective view of the snowplow assembly of the invention.

FIG. 1 further shows the lightweight snowplow assembly 10 having the snowplow portion 11 connected to the harness or mounting structure 12 and attached to the front end of vehicle 15 by means of flexible straps. Bumper pads 42 and tubular foam pads 45 are used to protect the automobile bumper and hood, respectively, as the snowplow assembly 10 is attached to the automobile above and below the bumper. The vehicle 15 is shown having the snowplow assembly 10 attached to the rear of the hood and to the vehicle frame below the bumper. This mounting configuration is one method of attachment of the assembly 10 to the front of a vehicle. FIG. 2 shows the snowplow portion 11 attached to the harness or mounting structure 12. As shown the assembled portions are joined to form the snow plow assembly 10. The mounting device 12 is pivotable and adjustably connected to the snowplow portion 11 to permit adjustment of the assembly 10 to the configuration of the vehicle.

Referring to FIGS. 1 and 2, the snowplow assembly 10 is a lightweight structure comprised of a bladed snowplow portion 11 adjustably attached to a harness or mounting device 12 which attaches the assembly 10 to the front of a vehicle at designated areas above and below the front bumper. The blade portion 11 includes a frame 13 to which the flexible blade members are mounted. Bumper pads 42 are mounted on the mounting device 12 to receive the plowing force of the snow blade portion 11. Each bumper pad 42 is shown having a bottom bumper extension 43 which is designed to engage beneath the bottom of the vehicle bumper. The bumper extensions 43 position and maintain the harness portion 12 in place with respect to the vehicle bumper, particularly with respect to upward forces. The V-shaped blade portion 11 has wear pads 30 extending from the bottom of the blade structures 27 and 28. A biasing structure 34 is attached between the front and rear of the frame 13 of the bladed snowplow portion 11 and connects, as shown with respect to collar 31, with the lower frame member of the harness portion 12 to maintain the snowplow assembly 10 in proper position during use. The configuration of the bumper pads 42 also aids in maintaining the snowplow assembly 10 in proper position with respect to the vehicle bumper during use. The biasing structure 34, provides and maintains a downward force to the front end of the snowplow device 11 of the snowplow assembly 10.

Figure 3:
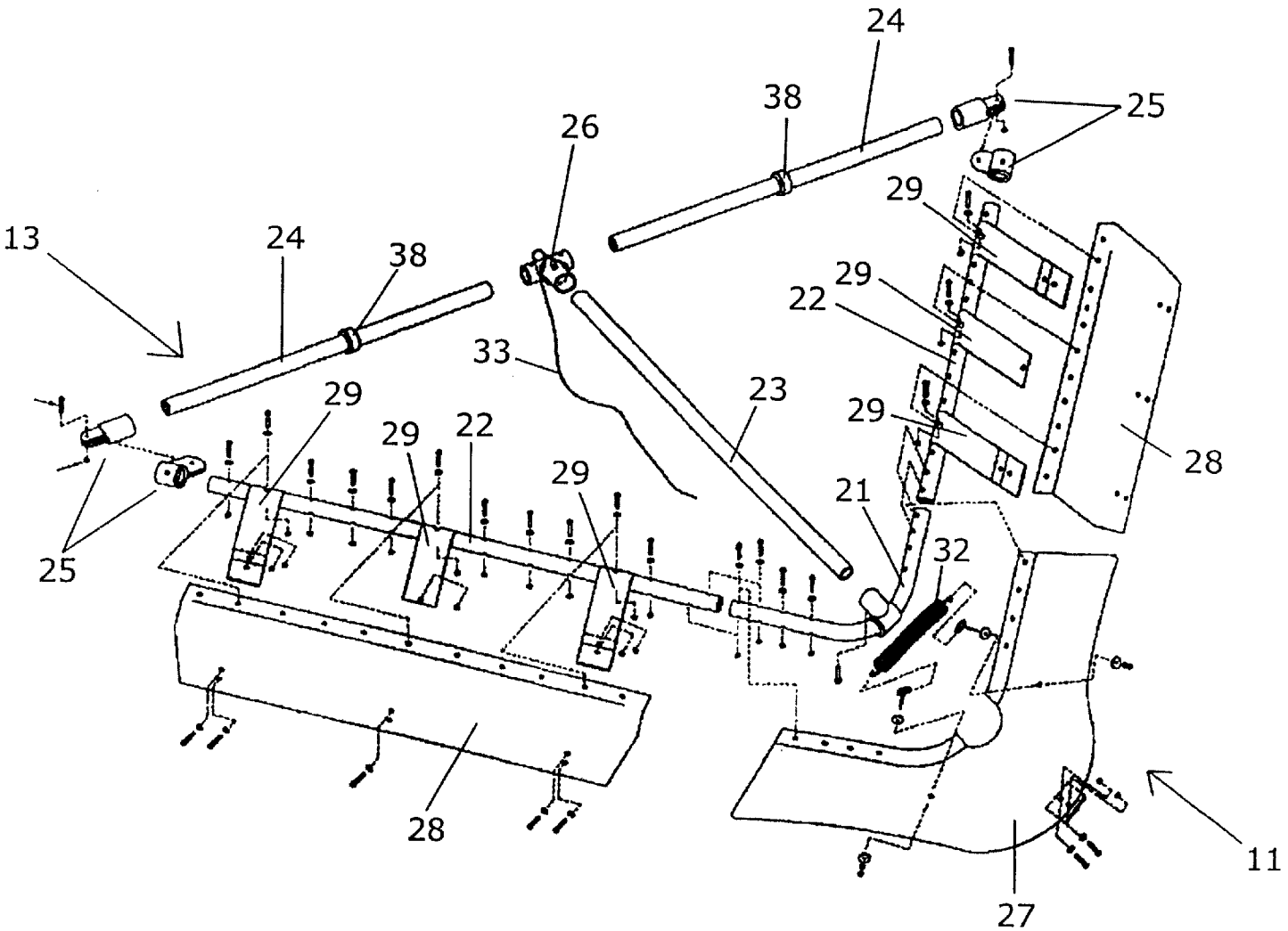
FIG. 3 is an exploded view showing the snowplow blade and support frame structure of the present invention.

Referring to FIGS. 2 and 3, the various elements that comprise the snowplow assembly 10 of the present invention are shown. FIG. 3 is an exploded view of the snowplow portion 11, specifically, snowplow blade assembly 11 and support frame structure 13. The support frame structure 13 is comprised of nose frame 21, side frames 22, main frame 23, and corner frame 24. Corner frame members 24 have collars 38 and are attached together and to the main frame by a three socket tee 26. Frame members 22 are shown attached to corner frame member 24 by means of female and male coupling members 25. Nose blade member 27 is attached to nose frame 21 by a plurality of bolts, although other fastening means may be utilized. The snowplow blade assembly 11 includes the support frame structure 13 and to which the nose blade 27 and side blades 28 are connected. A plurality of side supports 29 are shown utilized with respect to side blades 28.

FIG. 3 is an exploded view of the snowplow portion 11 and showing it comprised of three blades 28, 27, 28 and a support frame structure 13. The flexible blades 27 and 28 form a V-shaped blade structure having an obtuse angle with the center nose blade portion 27 positioned at the angle vertex. Side blades 28 are attached to the frame structure on either side of nose blade 27. The nose blade 27 and the side blades 28 are shown attached to the nose frame 21 and to the side frames 22. Opposing comer frames 24 and mainframe 23 are connected to the ends of side frames 22. The other end of each comer frame connects to a side frame using a female coupling 25. The main frame and comer frames are connected by means of a three socket tee 26.

Figure 4:
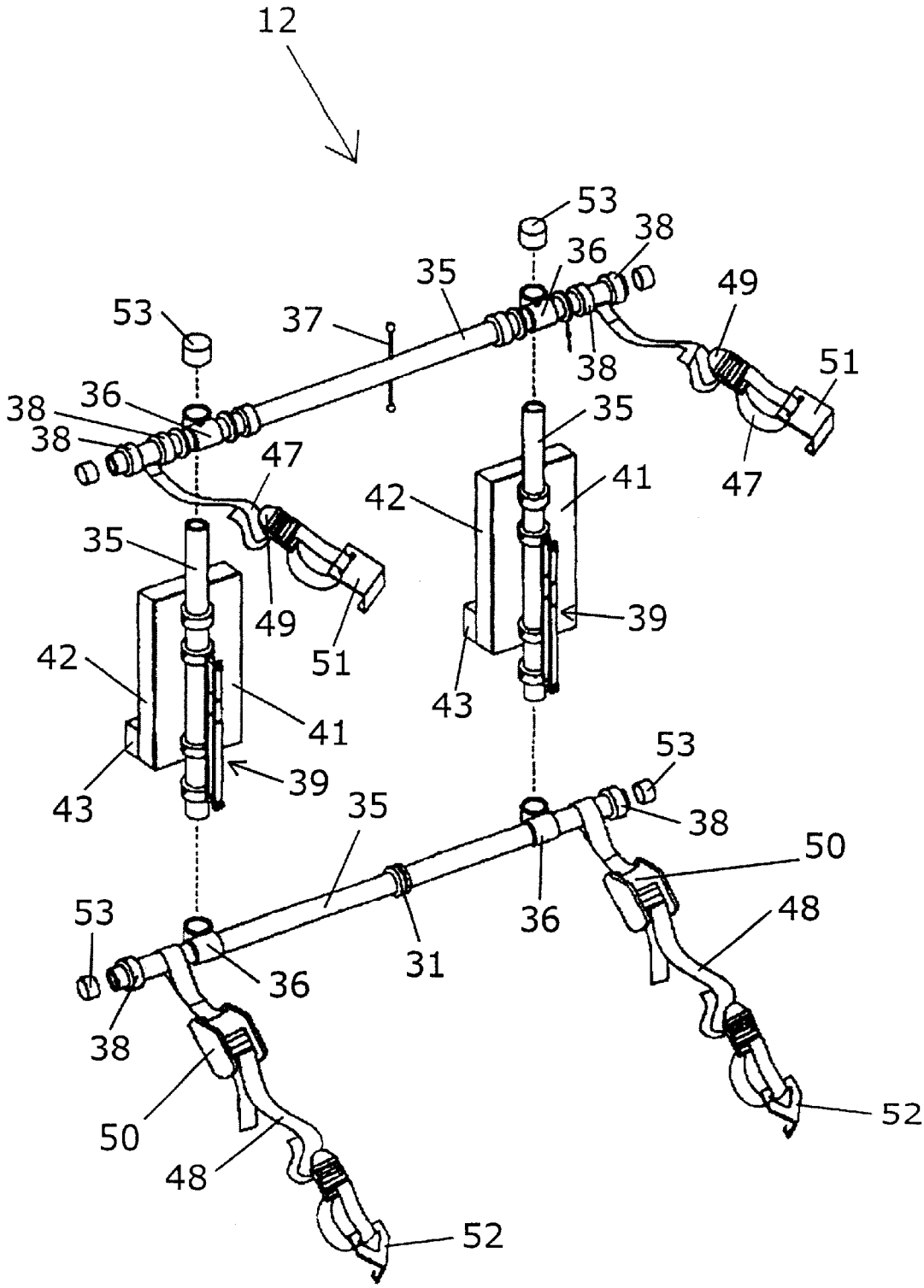
FIG. 4 is a perspective view showing the mounting or harness structure of the invention.

FIGS. 2 and 4 show the harness or mounting device 12. The mounting device 12 is comprised of a frame structure which is assembled by means of frame members 35 which are interconnected by crossover sockets 36. A pair of foam pad assemblies 42 are shown attached to the frame of the mounting device 12 and which abut the bumper of the vehicle to which the snowplow assembly 10 is mounted. Plates 41 are shown mounted to opposing side frame members 35 and the foam pads 42 are attached to the plates 41. The pads 42 provide the interface between the front and bottom of the vehicle bumper and the snowplow assembly 10. The bottom bumper extensions 43 aid in positioning the mounting or harness portion 12 with respect to the vehicle bumper. The bumper extensions 43 help prevent the harness portion from lifting upward during use of the snowplow assembly 10. Opposing pairs of straps 47 and 48 are shown extending from the frame structure and these are used to connect the snowplow assembly to the front end of the vehicle.

As further shown in FIGS. 2 and 4, the harness or mounting portion 12 is comprised of interconnected frame members 35 and wherein the top frame member 35 has top straps 47 connected at its ends. The top straps 47 have clips 51, for example, which are adapted to be attached to the rear of the vehicle hood or to the vehicle frame above the bumper. Each top strap 47 is provided with a buckle to permit proper adjustment for attachment to a particular style of vehicle. The bottom frame member 35 has bottom straps 48 attached at its ends and which are disposed opposite the top straps 47. The bottom straps 48 are provided with J-hooks 52 which are adapted to be attached to the frame of the vehicle, such as to the tow hook holes. Methods of attachment, which are further described below are used to attach the snowplow assembly 10 to the front of a vehicle.

FIG. 4 is a perspective view further showing the components of the harness portion structure 12. Harness portion 12 supports the snowplow portion 11 and is shown comprised of harness frame members 35 attached by cross over sockets 36 with collars 38 and end caps 53. Attached to the vertical frame members 35 are foam pads 42 to protect the bumper or surface of the vehicle to which the snowplow assembly 10 is attached. Foam pads 42 are mounted to steel plates 41. Plates 41 are attached to vertical frame members 35. The harness portion 12 is attached to a vehicle by top straps 47 with clips 51, and bottom straps 48 with hooks 52. U-channels 39 are show attached to the upright frame member 35 of the harness portion 12. The U-channels 39 are shown attached to upright frame members 35 of the harness portion 12. U-channels 39 are shown having a pair of collars that are positioned adjacent the collars to which the plates 41 are mounted. The U-channels 39 each have spaced members between which the corner frame 24 is positioned. Each U-channel 39 has spacers 40 which extend over a threaded rod (not shown) and which are removable by means of a nut, for example, so that the corner frame 24 of the frame structure 13 of the snowplow portion 11 can be positioned and retained therein. As shown in FIG. 2, the corner frame 24 of the snowplow portion 11 is placed within the confines of each U-channel 39. The latter configuration permits the snowplow portion 11 to move up and down in the harness portion 12 and thus, with respect to the terrain being plowed.

The harness portion 12 is constructed and arranged to be easily mounted and secured to the vehicle and positioned to fit against the vehicle bumper. To attach the harness portion 12 of the snowplow assembly 10 to the front of the vehicle, the top straps 47 and bottom straps 48 are respectively attached to vehicle positions above and below the bumper. For example, hooks 52 are attached to the vehicle frame below the bumper and the cam buckles 50 are used to adjust and tighten the bottom straps 48. The clips 51 of the top straps 47 are attached to the rear of the vehicle hood and the top straps 47 are adjusted and tightened by means of handle 37 connected to top frame member 35 of the harness portion 12. The respective top straps 47 are shown attached at one end to the top frame member 35 bottom collars 38. A pin (not shown) is positioned between each set of collars 38 to form a spool at the respective ends of the top frame member 35. By utilizing handle members 37 the top frame member 35 is turned to wrap the top straps 47 about the respective spools to thereby tighten the straps 47 and to secure the harness portion 12 to the front of the vehicle. Set screws (not shown) in cross over socket 36 are used to fix the top frame member 35 in place for tightening or releasing the straps 47.

Figure 5:
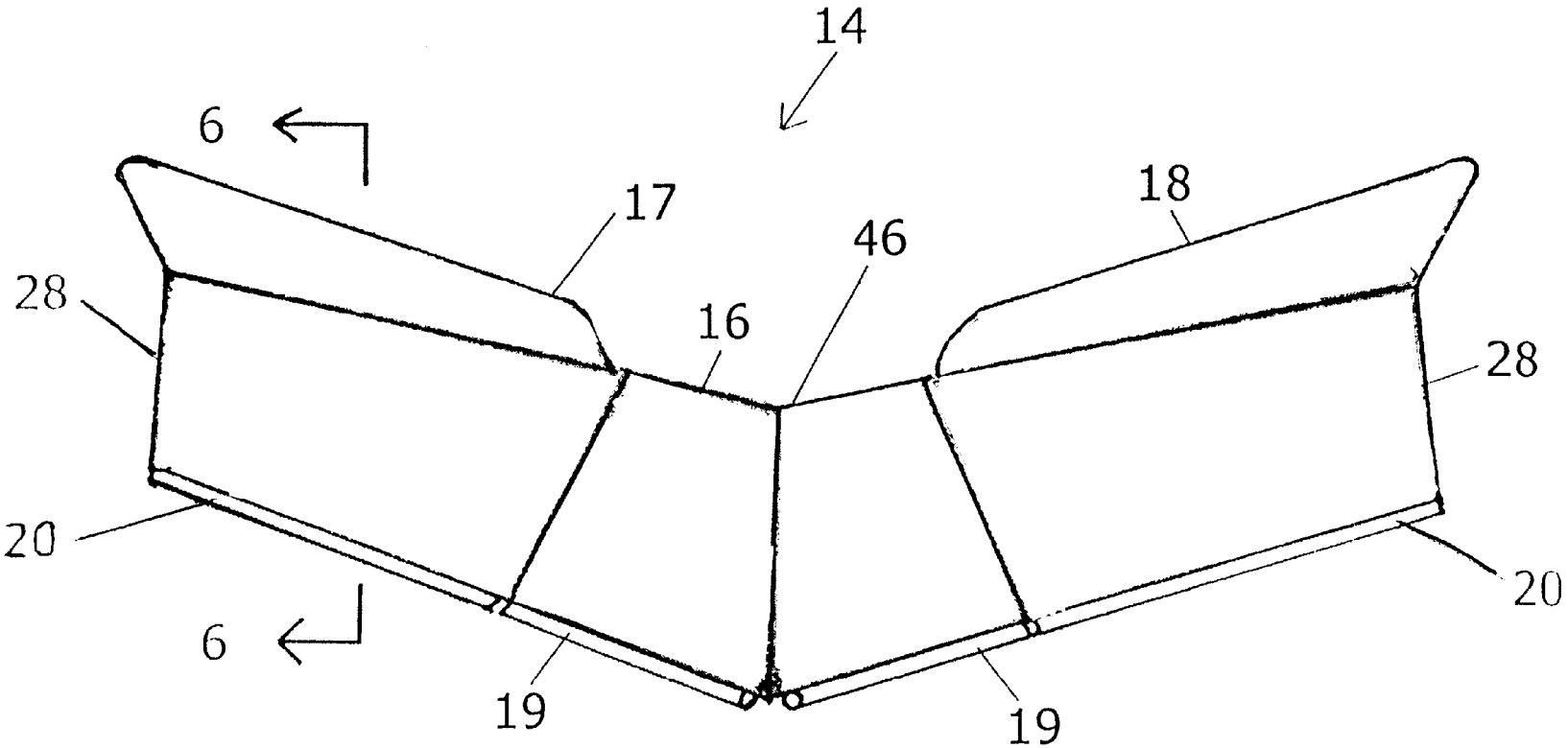
FIG. 5 is a front view of another embodiment of the snowplow portion of the present invention.
Figure 6:
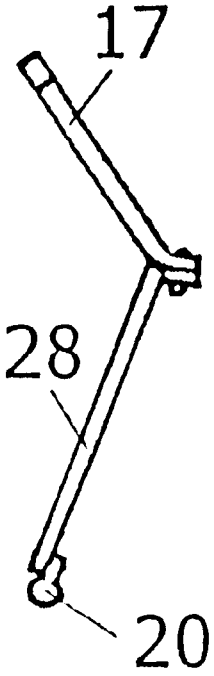
FIG. 6 is a sectional view of the snowplow portion taken along line 6—6 of FIG. 5.

FIG. 5 shows an alternate embodiment 14 of the snowplow portion. The nose blade 16 is shown comprised of a V-shaped member having elongated were pads 19 attached to the bottom thereof. The nose blade 16 is V-shaped and has center crease 46. The side blade members 28 also have elongated wear pad strips 20 attached to the bottom thereof. Further, chute members 17 and 18 are shown attached to the top of each side blade member 28. FIG. 6 is a sectional view showing the angle of the chute member 17 with respect to the side blade 28 and also showing the configuration of the wear pads 20. The wear pads 19 and 20 are generally rounded cross-sectional strips having an elongated strip portion extending from and along the top for fastening to the bottom of the respective blade members.

As shown in FIG. 6, the chute member 17 is disposed at an angle with respect to side blade 28. In a preferred embodiment the angle in cross-section between the chute member and side blade is approximately 120°. The chute members and blades of the snowplow portion are preferably constructed of a plastic composition, i.e., HDPE or the like. The frame members are preferably constructed of steel tubing or the like and the various socket members are constructed of cast iron or the like. The collars are generally constructed of a steel or the like, the straps made of nylon and polypropylene and the buckles of plastic and steel. These compositions are exemplary and other compositions may be used in the teachings of the invention.

In summary, the lightweight snowplow assembly of this invention is used for snow removal. The snowplow assembly is readily assembled and can be easily attached to and removed from the front end of an automobile. The assembly further has adjustable features to enable mounting to a variety of vehicle front end configurations. The snowplow assembly is constructed primarily of steel and plastic elements (blade, chute, and wear strip members) and weighs about 70 lbs. As shown, the snowplow assembly clears a path approximately 6 feet wide. The blade heights are approximately 12 inches and the chute tapers upwardly from about 4 inches to about 8 inches.

It is also within the purview of the invention to attach other implements to the harness portion 12. For example, a rotating brush assembly, a lawn mowing structure and like assemblies may be attached to the harness portion 12 fixed to the vehicle. Further, items such as bicycles, and the like may be attached and secured to the harness portion for transport.

As many changes are possible to the embodiments of this invention utilizing the teachings thereof, the descriptions above, and the accompanying drawings should be interpreted in the illustrative and not the limited sense.

That which is claimed is:

1. A snowplow assembly for attachment to the front of a vehicle having a front bumper, comprising:

a. a snowplow blade portion;

b. a support frame structure attached to said snowplow blade portion, said support frame structure is comprised of a nose blade frame member, a pair of side blade frame members, a center frame member and a pair of corner frame members;

c. a vertically movable mounting structure for adjustably attaching said support frame structure of the snowplow blade portion to the front of a vehicle, said mounting structure having a mounting frame having at least one adjustable strap attached thereto, said mounting structure being constructed and arranged to move vertically with respect to said support frame structure; and d. a biasing structure connected between said snowplow blade portion and said mounting structure said mounting structure having a pair of U-channels attached to said mounting frame and said corner frame members of said support frame structure being positioned for movement in said U-channels of said mounting structure.

2. The snowplow assembly of claim 1, wherein said snowplow blade portion is comprised of a nose blade and adjacent side blades and wherein said snowplow blade portion is comprised of a plastic composition.

3. The snowplow assembly of claim 2, wherein each said side blade has at least one wear strip mounted to the bottom thereof and wherein a chute member is attached to the top thereof.

4. The snowplow assembly of claim 1, wherein said mounting structure is further comprised of a pair of bumper pads, and wherein said at least one adjustable strap is comprised of a pair of top straps and a pair of bottom straps.

5. The snowplow assembly of claim 4 wherein said bottom straps are adjustable and each have a fastening member for attachment to a location below the bumper of the vehicle and wherein said top straps are adjustable and each have fastening members constructed and arranged to engage a location above the bumper of the vehicle.

6. The snowplow assembly of claim 4, wherein said mounting frame is comprised of four frame members and four cross-over sockets which form a rectangular or square frame structure.

7. A lightweight snowplow assembly for mounting to the front of a vehicle having a bumper and a hood comprising:

a. a plow blade portion having a plurality of individual blade elements including a nose blade and side blades;

b. a support frame structure for attachment to said plow blade portion and comprising a nose frame, side blade frame members, a center frame member and a corner frame member;

c. a harness structure for attachment to said support frame structure, said harness structure having a harness frame, at least one bumper pad and a pair of opposing straps members for attaching said snowplow assembly to the vehicle; and d. a biasing structure connected between said plow blade portion and said harness structure, said harness structure having at least one pair of U-channels attached to said harness frame and said corner frame member of said support frame structure being positioned for movement in said U-channels of said harness structure.

8. The snowplow assembly in claim 7, wherein said nose blade and said side blades are constructed of a lightweight plastic composition, wherein at least one wear strip is mounted to the bottom of said plow blade portion and wherein at least one chute member is attached to the top of said plow blade portion.

9. The snowplow assembly of claim 7, herein said nose blade frame member, said side blade frame members, said center frame member and said corner frame member of said frame support structure are comprised of tubular members.

10. The snowplow assembly of claim 9, wherein said support frame structure includes female and male coupling members to form a triangular frame structure.

11. The snowplow assembly of claim 7, wherein said harness frame is comprised of four frame members and four cross-over sockets to form a rectangular or square frame structure.

12. The snowplow assembly of claim 11, wherein said four frame members are comprised of tubular members and wherein said rectangular or square frame structure includes a top and bottom.

13. The snowplow assembly of claim 12, wherein said opposing strap members include a pair of top strap members and a pair of bottom strap members and wherein said top strap members are attached to said top of said frame structure and wherein said bottom strap members are attached to said bottom of said frame member.

14. The snowplow assembly of claim 13, wherein said bottom straps are adjustable and wherein each have a fastening member for attachment to a location below the bumper of the vehicle and wherein said top straps are adjustable and wherein each have fastening members constructed and arranged to engage a location above the bumper of the vehicle.

15. The snowplow assembly of claim 7, wherein said biasing structure is comprised of an elongated flexible member and spring means.

16. The snowplow assembly of claim 7, wherein tubular foam pads are placed about said opposing strap members.

17. A lightweight snowplow assembly for mounting to the front of a vehicle having a bumper and a hood comprising:

a. a plow blade portion having a plurality of individual blade elements including a nose blade and side blades;

b. a support frame structure for attachment to said plow blade portion and comprising a nose blade frame member, side blade frame members, a center frame member and a corner frame member;

c. a harness structure for attachment to said support frame structure, said harness structure having a harness frame, a pair of U-channels, a pair of bumper pads and a pair of opposing strap members for attaching said snowplow assembly to the vehicle: and d. said corner frame member of said support frame structure being positioned for movement in said U-channels of said harness structure.

* * * * *